US007866943B2

(12) United States Patent
Durand et al.

(10) Patent No.: US 7,866,943 B2
(45) Date of Patent: Jan. 11, 2011

(54) DEVICE FOR ATTACHING RING SECTORS TO A TURBINE CASING OF A TURBOMACHINE

(75) Inventors: Didier Noel Durand, Pontault Combault (FR); Dominique Gehan, Paris (FR)

(73) Assignee: SNECMA, Paris (FR)

( * ) Notice: Subject to any disclaimer, the term of this patent is extended or adjusted under 35 U.S.C. 154(b) by 957 days.

(21) Appl. No.: 11/693,258

(22) Filed: Mar. 29, 2007

(65) Prior Publication Data

US 2007/0231132 A1 Oct. 4, 2007

(30) Foreign Application Priority Data

Mar. 30, 2006 (FR) ..... 06 02748

(51) Int. Cl.
*F01D 25/28* (2006.01)

(52) U.S. Cl. ..... 415/173.1; 415/213.1

(58) Field of Classification Search ..... 415/173.1, 415/213.1, 214.1
See application file for complete search history.

(56) References Cited

U.S. PATENT DOCUMENTS

| | | | | |
|---|---|---|---|---|
| 5,188,507 | A * | 2/1993 | Sweeney | 415/173.1 |
| 5,593,277 | A * | 1/1997 | Proctor et al. | 415/173.1 |
| 6,893,217 | B2 * | 5/2005 | Brainch et al. | 415/189 |
| 7,334,984 | B1 * | 2/2008 | Stine et al. | 415/173.1 |
| 2005/0002779 | A1 | 1/2005 | Tanaka | |

FOREIGN PATENT DOCUMENTS

EP 1 079 076 A2 2/2001

OTHER PUBLICATIONS

U.S. Appl. No. 11/691,749, filed Mar. 27, 2007, Durand, et al.

* cited by examiner

*Primary Examiner*—Ninh H Nguyen
(74) *Attorney, Agent, or Firm*—Oblon, Spivak, McClelland, Maier & Neustadt, L.L.P.

(57) ABSTRACT

Device for attaching ring sectors (20) to a turbine casing (16) in a turbomachine, comprising, at the upstream ends of the ring sectors (20), circumferential coupling means (70, 72) engaged on a casing rail (50) and clamped axially onto the casing rail by a C-section annular locking member (80) engaged axially on the casing rail and on the ring sector coupling means.

9 Claims, 2 Drawing Sheets

DEVICE FOR ATTACHING RING SECTORS TO A TURBINE CASING OF A TURBOMACHINE

The present invention relates to a device for attaching ring sectors to a turbine casing in a turbomachine such as an aircraft turbojet or turboprop in particular.

BACKGROUND OF THE INVENTION

A turbomachine turbine comprises several stages, each including a guide vane element formed of an annular array of fixed blades supported by a casing of the turbine and a rotor mounted so as to rotate downstream of the guide vane element in a cylindrical or frustoconical envelope formed by ring sectors attached circumferentially end-to-end to the turbine casing.

The ring sectors comprise at their upstream ends circumferential means such as cylindrical rims engaged with a slight axial clearance in a radially inner annular groove of an annular casing rail and held radially in this groove by a C-section annular locking member that is engaged axially from upstream on the casing rail and on the cylindrical rims of the ring sectors. These sectors are held axially by their cylindrical rims engaged in the groove of the casing rail.

The rims of the ring sectors are "decambered" relative to the casing rail and to the locking member, that is to say that the rims of the ring sectors have a radius of curvature greater than that of the casing rail and of the locking member, which makes it possible to mount the rims of the ring sectors with a certain radial prestress between the bottom of the groove of the rail and the locking member and thereby to limit the axial movements of the rims of the ring sectors in the groove.

In operation, the differential thermal expansions of the ring sectors and of the casing cause an increase in this radial prestress that is applied in isolated zones of contact between the rims of the ring sectors and the casing rail. But this prestress disappears progressively over time by wear of the rims of the ring sectors and of the casing in these zones of contact. When this radial prestress is zero, the rims of the ring sectors may move axially in the casing groove and wear by friction the upstream and downstream faces of the casing groove.

When this wear exceeds a certain value, the rims of the ring sectors may, by moving downstream in the groove, disengage from the locking member which has the result of tilting the ring sectors toward the axis of the turbine and risking contact between the ring sectors and the turbine rotor, likely to cause destruction of the ring sectors and of the rotor.

SUMMARY OF THE INVENTION

The particular object of the invention is to provide a simple, effective and economic solution to this problem.

Accordingly, it proposes a turbomachine turbine comprising at least one guide vane element formed of an annular array of fixed blades supported by a casing of the turbine, and a rotor mounted so as to rotate downstream of the guide vane element in a substantially frustoconical envelope formed by ring sectors attached circumferentially end-to-end only at their upstream ends to the turbine casing, the ring sectors comprising at their upstream ends circumferential coupling means that are engaged on a casing rail and that are held by a C-section annular locking member engaged axially on the casing rail and on the coupling means of the ring sectors, wherein the coupling means of the ring sectors are interposed axially between the locking member and the casing rail and clamped axially on the casing rail by the locking member.

Thanks to the invention, the coupling means of the ring sectors are immobilized axially on the casing rail by the locking member, which prevents the coupling means from wearing by friction the casing rail and prevents them from coming out of the locking member.

Advantageously, the coupling means of the ring sectors are also immobilized radially on the casing rail by the locking member.

The device according to the invention has the further advantage of allowing the ring sectors to be attached to a casing rail independently of the wear of the latter.

According to a preferred embodiment of the invention, the coupling means comprise an annular collar extending radially outward at the upstream end of each ring sector.

The annular collar of each ring sector is preferably formed at the upstream end of a cylindrical rim of the ring sector, and is for example clamped axially between a radial wall of the annular locking member and an upstream end of the casing rail.

The C-section locking member and its radial wall is connected at its ends to cylindrical walls extending in the downstream direction and engaged respectively on the outside of the casing rail and on the inside of the cylindrical rim of each ring sector.

The locking member is interposed axially between the collars of the ring sectors and an outer annular wall of a turbine guide vane element, so as to exert on the annular collars an axial force in the downstream direction when the guide vane element is itself pushed downstream by the gas flow traveling into the turbine. This axial force exerted by the locking member is sufficient to axially immobilize the collars of the upstream rims of the ring sectors on the casing rail.

The invention also relates to a turbomachine, such as an aircraft turbojet or turboprop, comprising a turbine as described hereinabove.

BRIEF DESCRIPTION OF THE DRAWINGS

The invention will be better understood and other features, details and advantages of the latter will appear more clearly on reading the following description, given as a nonlimiting example and with reference to the appended drawings in which.

DESCRIPTION OF THE PREFERRED EMBODIMENTS

Figure 1:
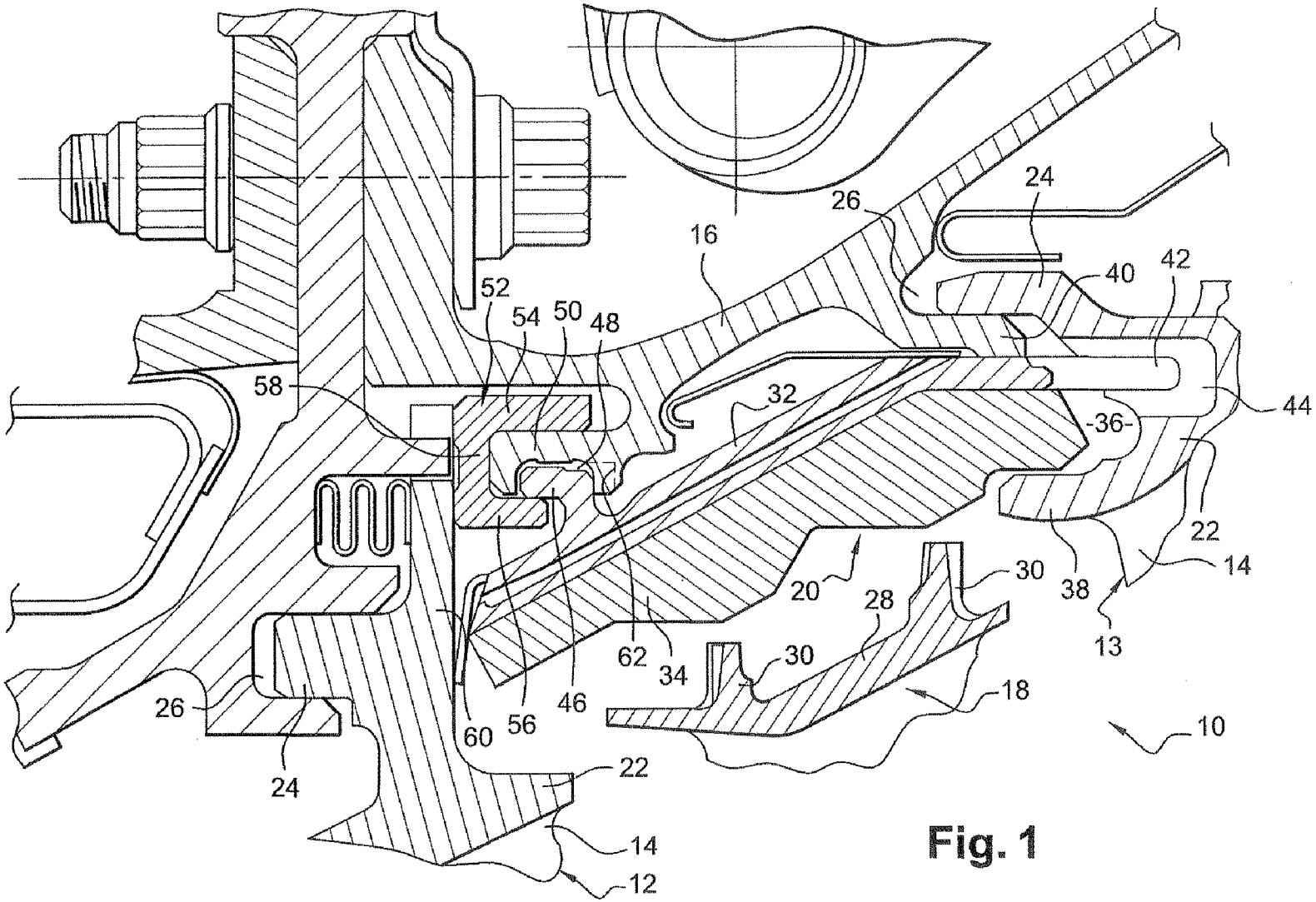
FIG. 1 is a partial schematic view in axial section of a device for attaching ring sectors according to the prior art.

The first stage or upstream stage of the low-pressure turbine 10 partially shown in FIG. 1 comprises a guide vane element 12, 13 formed of an annular array of fixed blades 14 supported by a casing 16 of the turbine, and a rotor 18 mounted downstream of the guide vane element 12, 13 and rotating in a substantially frustoconical envelope formed by ring sectors 20 supported circumferentially end-to-end by the casing 16 of the turbine.

The guide vane element 12, 13 comprises an outer wall of revolution 22 and an inner wall of revolution (not visible) respectively, that delimit between them the annular stream of gas flow in the turbine and between which the blades 14 extend radially. The means for attaching the guide vane element comprise at least one outer cylindrical rim 24 oriented in the upstream direction and designed to be engaged in an annular groove 26 oriented in the downstream direction of the casing 16.

The rotor 18 is supported by a turbine shaft (not shown) and comprises an outer ring 28 and an inner ring (not visible), the outer ring 28 comprising outer annular ribs 30 surrounded externally with a slight clearance by the ring sectors 20.

Each ring sector 20 comprises a frustoconical wall 32 and a block 34 of abradable material attached by brazing and/or welding to the radially inner surface of the wall 32, this block 34 being of the honeycomb type and being designed to wear by friction on the ribs 30 of the rotor to minimize the radial clearances between the rotor and the ring sectors 20.

The downstream ends of the ring sectors 20 are engaged from upstream in an annular space 36 delimited by a cylindrical rim 38 oriented in the upstream direction of the outer wall 22 of the guide vane element 13 situated downstream of the ring sectors, on the one hand, and by a cylindrical rim 40 of the casing to which this guide vane element is coupled, on the other hand.

The ring sectors 20 are held radially at their downstream ends by radial outward pressure of their walls 32 on a radially inner cylindrical face of the rim 40 of the casing, and by radial inward pressure of their blocks 34 of abradable material on a radially outer cylindrical face of the cylindrical rim 38 of the guide vane element.

The walls 32 of the ring sectors each comprise at their downstream ends a lug 42 extending axially in the downstream direction and designed to be engaged in a matching cavity 44 of the downstream guide vane element 13 to prevent the ring sectors 20 from rotating about the axis of the turbine.

The frustoconical walls 32 of the ring sectors 20 comprise at their upstream ends cylindrical rims 46 oriented in the upstream direction that are engaged with a slight axial clearance in a radially inner annular groove 48 of an annular rail 50 of the casing 16. The rims 46 are held radially in this groove by means of a locking member 52 formed of a C-section or U-section split ring engaged axially from upstream on the annular rail 50 of the casing and on the upstream rims 46 of the ring sectors.

The locking member 52 comprises two cylindrical walls 54 and 56 extending in the downstream direction, radially outer and radially inner respectively, that are connected together at their upstream ends by a radial wall 58, and that are engaged respectively on the outside of the rail 50 and on the inside of the cylindrical rims 46 of the ring sectors 20.

The radial wall 58 of the locking member 52 is interposed axially between the upstream end of the casing rail 50 and an annular outer wall 60 of the guide vane element 12 situated upstream of the ring sectors 20, to prevent the locking member 52 from moving axially in the upstream direction and disengaging from the casing rail 50 and the rims 46 of the ring sectors.

The radius of curvature of the locking member 52 and of the rail 50 is less than that of the rims 46 of the ring sectors 20, which makes it possible to mount with a certain radial prestress the rims 46 of the ring sectors in the groove 48 of the rail, these ring sectors pressing locally in a radial manner on the bottom of the groove 48 and on the radially inner wall 56 of the locking element respectively.

In operation, the rims 46 of the ring sectors 20 vibrate axially and wear by friction the upstream and downstream faces of the groove 46 of the rail.

When the downstream face of the groove 48 is very worn (as is shown in dashed lines 62), the rims 46 can, by moving in the downstream direction, slide on the radially inner wall 56 of the locking member and disengage from the locking member, which may cause at least the destruction of the blocks 34 of abradable material of the ring sectors that come into contact with the annular ribs 30 of the rotor 18.

The invention makes it possible to provide a simple solution to this problem thanks to the rims of the ring sectors being axially immobilized on the casing rail by the locking member.

Figure 2:
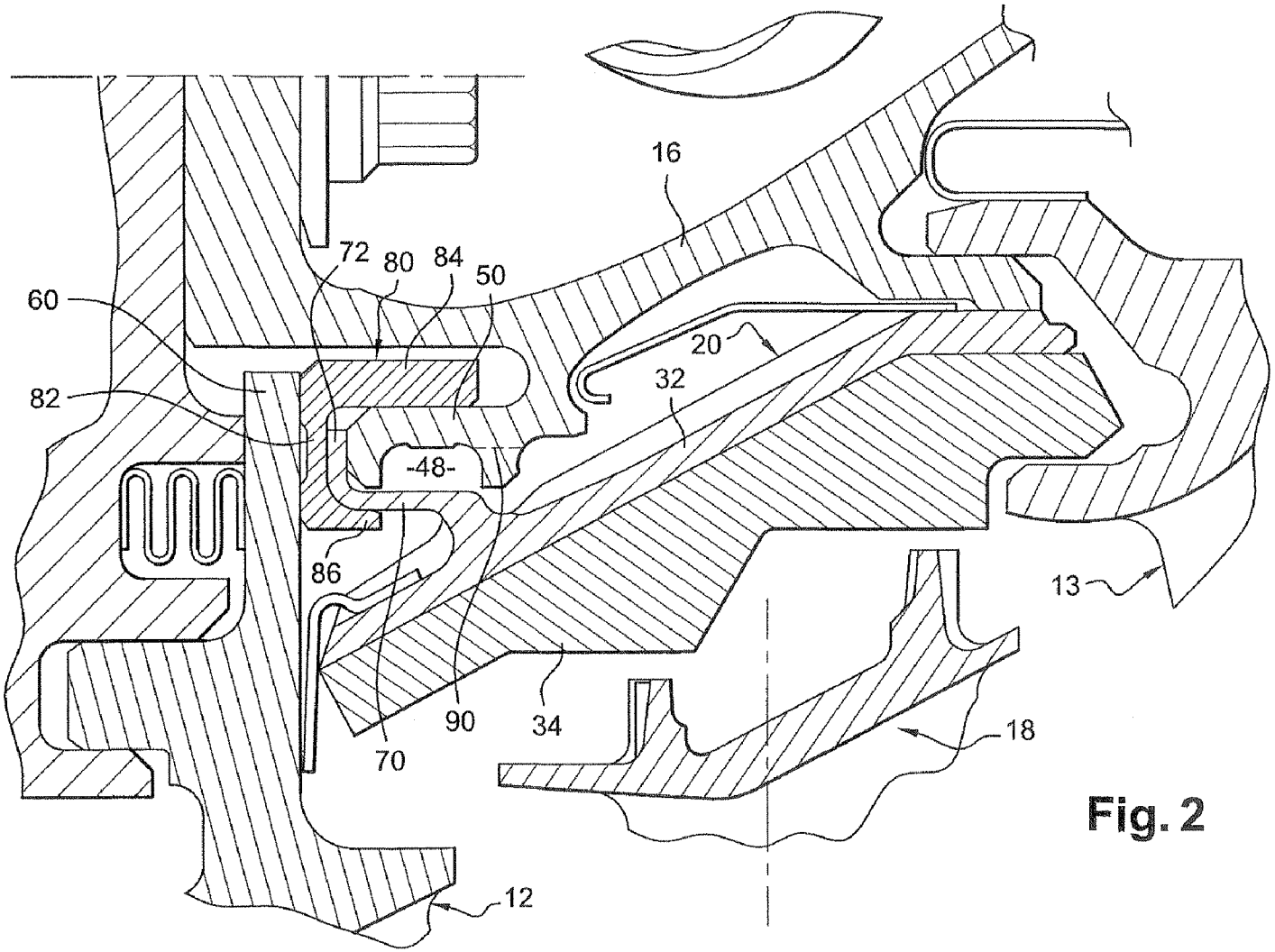
FIG. 2 is a partial schematic view in axial section of a device for attaching ring sectors according to the invention.

In an embodiment of the invention represented in FIG. 2, the upstream cylindrical rims 70 of the ring sectors 20 each comprise at their upstream end an annular collar 72 that extends substantially radially outward and that is clamped axially on the casing rail 50 by the locking member 80.

The locking member 80 comprises two cylindrical walls 84 and 86 extending in the downstream direction, radially outer and radially inner respectively, that are connected together at their upstream ends by a radial wall 82 that has a greater radial dimension than the radial dimension of the wall 58 of the locking member 52 of the prior art (FIG. 1).

The cylindrical rim 70 of the ring sector is longer than in the prior art, so that the annular collar 72 can be engaged between the radial wall 82 of the locking member and the upstream end of the casing rail.

The radially outer cylindrical wall 84 of the locking member 80 is engaged on the outside of the rail 50 and its radially inner wall 86 is engaged on the inside of the cylindrical rims 70 of the ring sectors 20, these rims 70 being radially interposed between the inner cylindrical wall 86 of the member and the upstream end face of the rail 50.

As in the prior art, the radius of curvature of the locking member 80 and of the rail 50 is less than that of the rims 70 of the ring sectors 20, which makes it possible to mount with a certain radial prestress the rims 70 of the ring sectors on the rail 50 and on the locking member.

The radial wall 82 of the locking member 80 is axially interposed between the annular collars 72 of the ring sectors 70 and the outer annular wall 60 of the guide vane element 12 situated upstream of the ring sectors 20.

In operation of the turbomachine, this guide vane element 12 is pushed downstream by the flow of gases and exerts an axial force directed in the downstream direction on the annular collars 72 of the ring sectors 70 by means of the locking member 80. This axial force is sufficient to keep the collars 72 of the ring sectors axially clamped on the casing rail 50.

The collars 72 of the ring sectors are therefore axially and radially immobilized by the locking member 80 on the casing rail 50, and can therefore not wear the casing rail by friction.

Furthermore, the ring sectors 20 according to the invention may be coupled to a casing rail 50 that is already worn as is shown by the dashed lines 90, which makes it possible to repair the upstream stage of the low-pressure turbine at less cost without touching the turbine casing.

In a variant embodiment, the upstream rim 70 of the ring sectors supports no collar 72 and extends axially up to the radial wall 82 of the locking member, along the cylindrical portion of the casing rail, that has no radial rim at its upstream end. The downstream end of the rim 70 is pressed axially on the casing rail by the locking member 80.

The invention claimed is:

1. A turbomachine turbine comprising at least one guide vane element formed of an annular array of fixed blades supported by a casing of the turbine, and a rotor mounted so as to rotate downstream of the guide vane element in a substantially frustoconical envelope formed by ring sectors attached circumferentially end-to-end only at their upstream ends to the turbine casing, the ring sectors comprising at their upstream ends circumferential coupling means that are engaged on a casing rail and that are held by a C-section annular locking member engaged axially on the casing rail and on the coupling means of the ring sectors, wherein the coupling means of the ring sectors are interposed axially between the locking member and the casing rail and clamped axially on the casing rail by the locking member.

2. The turbine as claimed in claim 1, wherein the coupling means comprise an annular collar extending radially outward at the upstream end of each ring sector.

3. The turbine as claimed in claim 2, wherein the annular collar of each ring sector extends between a radial wall of the annular locking member and an upstream end of the casing rail.

4. The turbine as claimed in claim 2 or 3, wherein the locking member is interposed axially between the annular collars of the ring sectors and an outer annular wall of a turbine guide vane element.

5. The turbine as claimed in claim 2, wherein, when the turbomachine operates, the annular member exerts an axial force directed in the downstream direction on the annular collars of the ring sectors.

6. The turbine as claimed in claim 2, wherein the annular collar of each ring sector is formed at the upstream end of a cylindrical rim of the ring sector.

7. The turbine as claimed in claim 6, wherein the annular locking member comprises an inner cylindrical wall extending in the downstream direction and engaged inside the cylindrical rim of each ring sector.

8. The turbine as claimed in claim 2, wherein the annular member provides axial and radial immobilization of the annular collars of the ring sectors on the casing rail.

9. A turbomachine, such as an aircraft turbojet or turboprop, which comprises a turbine as claimed in one of the preceding claims.

* * * * *

UNITED STATES PATENT AND TRADEMARK OFFICE

CERTIFICATE OF CORRECTION

PATENT NO. : 7,866,943 B2
APPLICATION NO. : 11/693258
DATED : January 11, 2011
INVENTOR(S) : Didier Noel Durand et al.

It is certified that error appears in the above-identified patent and that said Letters Patent is hereby corrected as shown below:

In the Claims:

Column 5, line 15, claim 4, delete "or 3."

Signed and Sealed this
Twenty-second Day of March, 2011

David J. Kappos

David J. Kappos
*Director of the United States Patent and Trademark Office*